US008708035B2

(12) United States Patent
Bruckmann et al.

(10) Patent No.: US 8,708,035 B2
(45) Date of Patent: Apr. 29, 2014

(54) HEAT EXCHANGER IN A MODULAR CONSTRUCTION

(75) Inventors: Wilhelm Bruckmann, Oberhausen (DE); Wolfgang Hegner, Bottrop (DE); Dirk Band, Ratingen (DE)

(73) Assignee: Balcke-Dürr GmbH, Ratingen (DE)

( * ) Notice: Subject to any disclaimer, the term of this patent is extended or adjusted under 35 U.S.C. 154(b) by 119 days.

(21) Appl. No.: 12/327,144

(22) Filed: Dec. 3, 2008

(65) Prior Publication Data

US 2010/0059216 A1 Mar. 11, 2010

(30) Foreign Application Priority Data

Sep. 8, 2008 (EP) ..... 08015786

(51) Int. Cl.
*F28F 9/26* (2006.01)
*F28D 7/08* (2006.01)
*F22B 1/18* (2006.01)

(52) U.S. Cl.
USPC ..... 165/145; 165/144; 165/157; 165/160; 165/163; 122/7 R

(58) Field of Classification Search
USPC ..... 165/144, 145, 157, 160, 163; 122/7 R
See application file for complete search history.

(56) References Cited

U.S. PATENT DOCUMENTS

| | | | | | |
|---|---|---|---|---|---|
| 2,199,216 | A | * | 4/1940 | Conti | 165/145 |
| 2,916,263 | A | * | 12/1959 | Godshalk | 165/145 |
| 3,110,288 | A | * | 11/1963 | Worley | 165/157 |
| 5,771,963 | A | * | 6/1998 | Blangetti et al. | 165/157 |
| 5,775,266 | A | * | 7/1998 | Ziegler | 122/7 R |
| 5,871,045 | A | | 2/1999 | Hirth et al. | |
| 6,019,070 | A | | 2/2000 | Duffy | 122/209.1 |

FOREIGN PATENT DOCUMENTS

| | | | |
|---|---|---|---|
| CN | 1813164 | A | 8/2006 |
| DE | 1199281 | B | 8/1965 |
| DE | 1776011 | A1 | 6/1971 |
| DE | 3248096 | A1 | 7/1984 |
| DE | 295 10 720 | U1 | 9/1995 |
| DE | 10127830 | A1 | 12/2002 |
| DE | 10222974 | A1 | 12/2003 |
| EP | 0228722 | A | 7/1987 |
| EP | 1519108 | A | 3/2005 |
| GB | 653540 | A | 5/1951 |

* cited by examiner

*Primary Examiner* — Leonard R Leo

(57) ABSTRACT

The invention relates to a heat exchanger in modular construction, in particular for facilities operated using large load and/or temperature changes, having an external shell and a number of heat exchanger modules, wherein each heat exchanger module, which is either a preheater, evaporator, or superheater module, has an entry manifold, and exit manifold, and meandering pipes, through which the heat-absorbing medium, in particular water, flows from the entry manifold to the exit manifold, and the heat exchanger modules are also situated in a shared external shell, so that they have the same heat-dissipating medium flowing around them, the evaporator modules being connected in parallel via a steam-collecting drum situated outside the external shell.

16 Claims, 7 Drawing Sheets

SECTION B-B

DETAIL "X"

SECTION A-A

HEAT EXCHANGER IN A MODULAR CONSTRUCTION

PRIORITY

This application claims priority of European Patent Application No. 08015786.0, filed Sep. 8, 2008, the entire contents of which is incorporated herein by reference.

FIELD OF INVENTION

The invention relates to a heat exchanger in modular construction for facilities in which large load and/or temperature oscillations occur, in particular solar power plants.

BACKGROUND OF INVENTION

A heat exchanger is known from DE 29510720 U1 of the applicant, which has proven itself best as a coolant air cooler for gas turbines in particular. It has pipes for separating the heat-dissipating medium and the heat-absorbing medium. The pipes are situated meandering between an inlet manifold and an outlet manifold and have a heat-absorbing medium flowing through them. The heat-dissipating medium flows around these meandering pipes.

The stresses of a mechanical and thermal nature occurring because of the frequent load and temperature changes may be successfully decreased with the aid of the heat exchanger known from DE 29510720 U1. Furthermore, the meandering shaping of the pipe bundle allows a "downsizing" of the heat exchanger with unchanged performance. In spite of the listed advantages, there is still a need for even more compact and efficient heat exchangers, which are flexible, but nonetheless may be produced cost-effectively. Heat exchangers for solar power plants, in particular parabolic trough power plants, must additionally have more rapid startup speeds having high temperature gradients.

SUMMARY OF INVENTION

Therefore, the invention is based on the object of further improving the heat exchanger known from DE 29510720 U1 and specifying a heat exchanger which allows a still more compact construction, so that even less space is required for the heat exchanger. Furthermore, it is the object of the invention to allow a flexible construction, in addition to decreasing the production costs.

The object is achieved by a heat exchanger according to the independent claim. Preferred refinements are listed in the dependent claims.

The heat exchanger according to the invention is constructed modularly. The heat exchanger modules, which can be a preheater module, an evaporator module, or a superheater module, are situated in a shared external shell, in which a heat-dissipating medium flows around the heat exchanger modules having the meandering pipe bundles. The heat exchanger thus unifies at least three different apparatuses in one. The heat exchange occurs according to the counter-flow and/or cross-flow principle. The meandering pipes have a heat-absorbing medium, such as water, flowing through them. Due to the meandering configuration of the pipe bundles, the overall size of the heat exchanger is decreased, the heat transfer from the heat-dissipating to the heat-absorbing medium is improved, and also the thermoelasticity of the construction is increased.

The invention is based, inter alia, on the finding that by situating the individual heat exchanger modules in a shared external shell, the overall size of the heat exchanger is significantly decreased with identical or even increased performance capability of the heat exchanger. A further advantage of the modular construction is the capability of flexible adaptation of individual heat exchanger modules, depending on the requirements. Thus, for example, depending on demand, individual modules may be added or only individual modules may be modified, for example, by changing the pipe bundle lengths. The effort for an extensive overall design of the heat exchanger is thus dispensed with. In addition, production costs may be lowered, because instead of the costly individual manufacturing of heat exchanger components, identical parts and/or identical modules may be used. Due to the saving of additional pipe connections between the individual modules and due to the compact construction, not only are material costs decreased, but rather also the efficiency of the heat exchanger is increased, because the heat loss to the environment is effectively reduced thanks to the decrease of the surface which is in contact with the environment.

The heat exchanger according to the invention does not necessarily comprise all three different types of modules like the preheater, the evaporator, and the superheater module. It is possible to combine the modules in any order. Therefore, the type of the modules combined in the heat exchanger and also the number of the modules used in the heat exchanger can be varied at will. For example, a heat exchanger according to the invention might comprise only a pre-heater module and a number of evaporator modules without a superheater module. It is also possible to arrange only evaporator modules and a superheater module in a shell without a pre-heater module. Furthermore, it is also imaginable to make use of only evaporator modules in a heat exchanger according to the invention. Due to this flexibility the heat exchanger according to the invention can be adapted to a specific application in an optimal way.

The flexibility and the efficiency are increased further by the connection in parallel of multiple evaporator modules using a steam-collecting drum. In addition, more rapid startup having higher temperature gradients may be achieved, which is of enormous significance in the event of changing load and temperature conditions of solar power plants, for example. According to a preferred embodiment variant of the invention, the pipes through which the heat-absorbing medium flows from the exit manifold of the particular evaporator module to the steam-collecting drum are connected to one another in such a way that they only have a single shared entry into the steam-collecting drum. Material costs and also the heat loss to the environment are thus further decreased.

According to a further advantageous refinement of the invention, the pipes through which the heat-absorbing medium flows from the steam-collecting drum to the entry manifold of the particular evaporator module may also be connected to one another in such a way that they have a single shared exit from the steam-collecting drum.

According to a preferred embodiment variant of the invention, the heat exchanger may be set up either horizontally or vertically. The vertical setup allows an even better area usage. Several of the heat exchangers according to the invention may be operated adjacent to one another in parallel on a relatively small area. In solar power plants in particular, the space conditions are unfavorable, because the parabolic trough collectors occupy a very large amount of space. The space-saving construction of the heat exchanger according to the invention allows an almost location-independent setup, so that the flow paths of the heated media to the heat exchanger may expediently be shortened. The temperatures of the heat-dissipating medium upon entry into the heat exchanger are higher, so that the heat yields are better.

A further preferred embodiment variant of the invention provides that the heat exchanger module has a number of horizontal pipe layers in the event of horizontal setup, each pipe layer being formed by an equal number of pipes, and the pipe layers are situated in such a way that the pipes of the individual pipe layers lie oriented precisely one above another in the vertical direction, the flow directions of the heat-absorbing medium in the vertically adjacent pipe sections situated transversely to the central axis of the external shell being opposing. The implementation of the pipe bundles in individual pipe layers allows an extremely compact construction. Because the pipes lie vertically precisely one above another, typical spacers may be used between the pipes. The opposing flow in the vertically adjacent pipe sections, which are situated transversely to the central axis of the external shell, favor the symmetrical temperature distribution in the heat exchanger in relation to the central axis. This is correspondingly also true in the event of the vertical setup of the heat exchanger. In this case, the pipe layers lie vertically adjacent to one another, pivoted by 90° in relation to the horizontal setup, the preheater module expediently being lowest in the shared external shell.

The entry and exit manifolds preferably have a circular cross-section. The pipes of a pipe layer are connected to the particular entry and exit manifolds offset from one another by an equal angle on a peripheral plane of the particular entry and exit manifolds.

The production method is made easier in this way, because enough space is offered for welding work, machining, or other work on the manifolds.

Furthermore, the pipes of the adjacent pipe layers are preferably connected to the particular entry and exit manifolds in such a way that the pipes of one pipe layer are situated offset by an angle on an adjacent peripheral plane of the particular entry and exit manifolds in relation to the pipes of the adjacent pipe layer. The peripheral faces of the entry and/or exit manifolds may be optimally exploited in this way, so that the configuration of the pipe layers may be designed compactly. Enough space still remains for welding work, machining, or other work on the manifolds.

According to a preferred refinement of the invention, the pipes of the heat exchanger modules are situated in a shared internal housing, which is situated concentrically inside the external shell and has an entry and an exit opening for the heat-dissipating medium. The cross-sectional profile of the internal housing is preferably rectangular, so that the pipe bundles are enclosed as tightly as possible by this internal housing. Further insulation between the heat exchanger modules and the environment is provided by the additional enclosure of the heat exchanging components. Alternatively, the space between the external shell and the internal housing may be used as an additional flow channel for the heat-dissipating medium. In this way, the dwell time of the heat-dissipating medium in the heat exchanger is lengthened, so that the heat transfer to the heat-absorbing medium may be improved.

BRIEF DESCRIPTION OF THE DRAWINGS

The invention is described in greater detail hereafter on the basis of figures. In the schematic figures.

DETAILED DESCRIPTION

Figure 1:
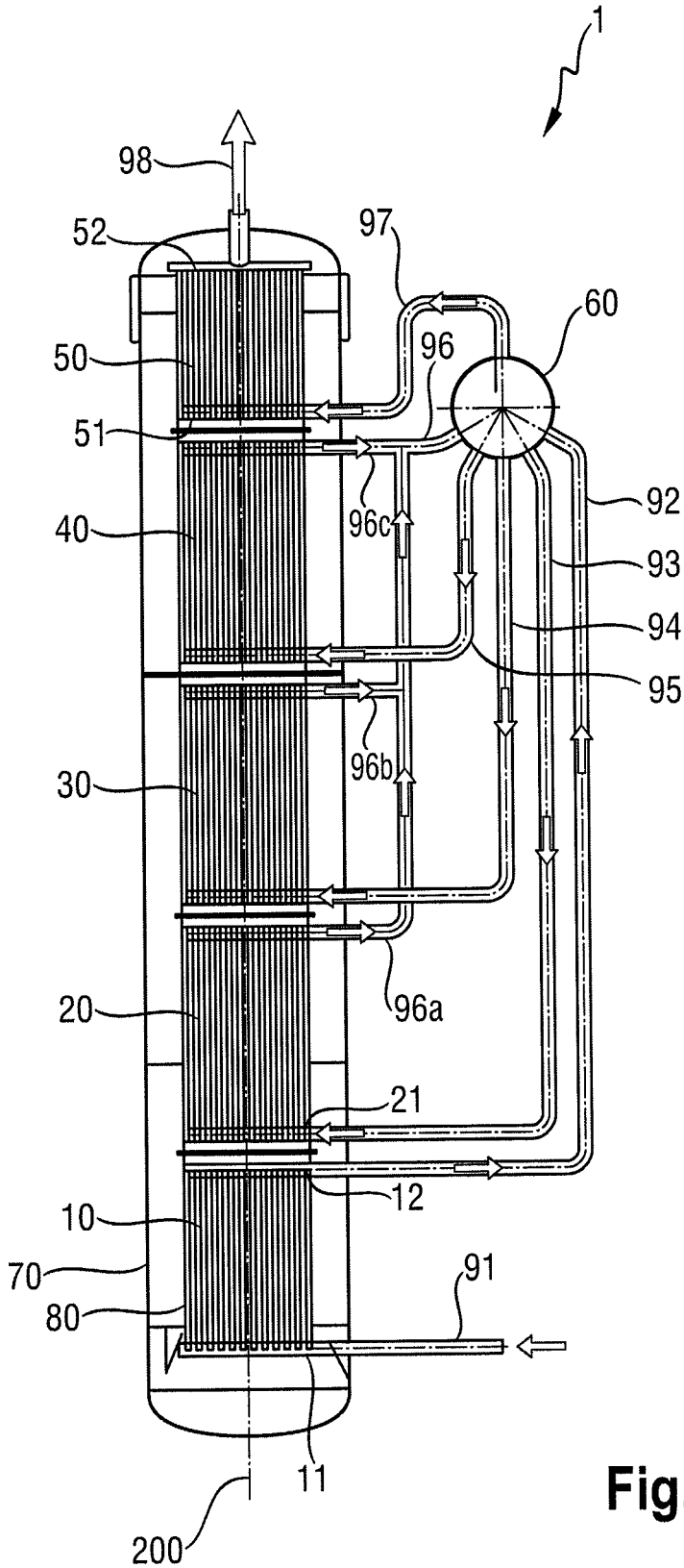
FIG. 1 shows a longitudinal section through a first embodiment variant with illustration of the pipe-side flow paths with vertical setup.

FIG. 1 shows a first exemplary embodiment. The heat exchanger 1 is set up vertically in a space-saving way. An internal housing 80, which has a rectangular cross-sectional profile, is located in the external shell 70. The meandering pipes 120 of the individual heat exchanger modules 10, 20, 30, 40, 50 are situated in the internal housing. The heat-absorbing medium, such as water, enters the entry manifold 11 of the preheater module 10 via the pipeline 91. After flowing through the pipes 120 of the preheater module 10, it enters the steam-collecting drum 60 via the exit manifold 12 of the preheater module 10 and via the pipeline 92. From the steam-collecting drum 60, the heated water enters the evaporator modules 20, 30, 40, which are connected in parallel, via the pipelines 93, 94, 95. The water-steam mixture from the evaporator modules 20, 30, 40 flows back into the steam-collecting drum 60 via a shared return flow line 96. The steam-collecting drum 60 has means (not shown here) for separating the water from the water-steam mixture, so that the dry steam reaches the entry manifold 51 of the superheater module 50 for superheating via the pipeline 97. The steam now superheated in the superheater module 50 exits the heat exchanger via the pipeline 98 and reaches the downstream turbine for power generation, for example.

Figure 2:
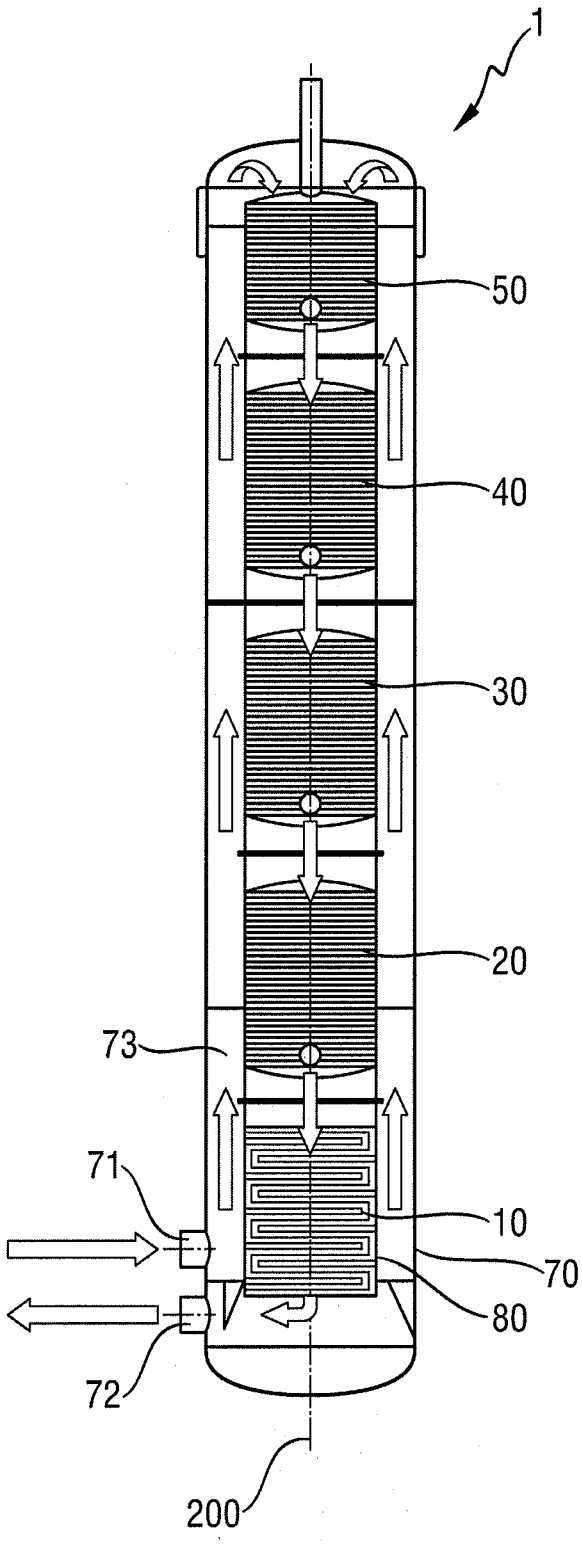
FIG. 2 shows a longitudinal section like FIG. 1, but with illustration of the shell-side flow paths.

FIG. 2 shows the identical exemplary embodiment as FIG. 1, but the flow path of the heat-dissipating medium is shown more precisely here. The heat-dissipating medium, which is thermal oil heated via solar energy in this case, enters at a temperature of approximately 400° C. via the entry connector 71 of the external shell 70. Via the channel 73, which is formed by the external shell 70 and the internal housing 80, the thermal oil enters the internal housing 80, in which the thermal oil flows around the pipes 120 of the super heater module 50, the three evaporator modules 40, 30, 20, and the preheater module 10 in sequence and thus dissipates the heat to water. The cooled thermal oil subsequently flows out of the heat exchanger 1 via the exit connector 72.

Figure 3:
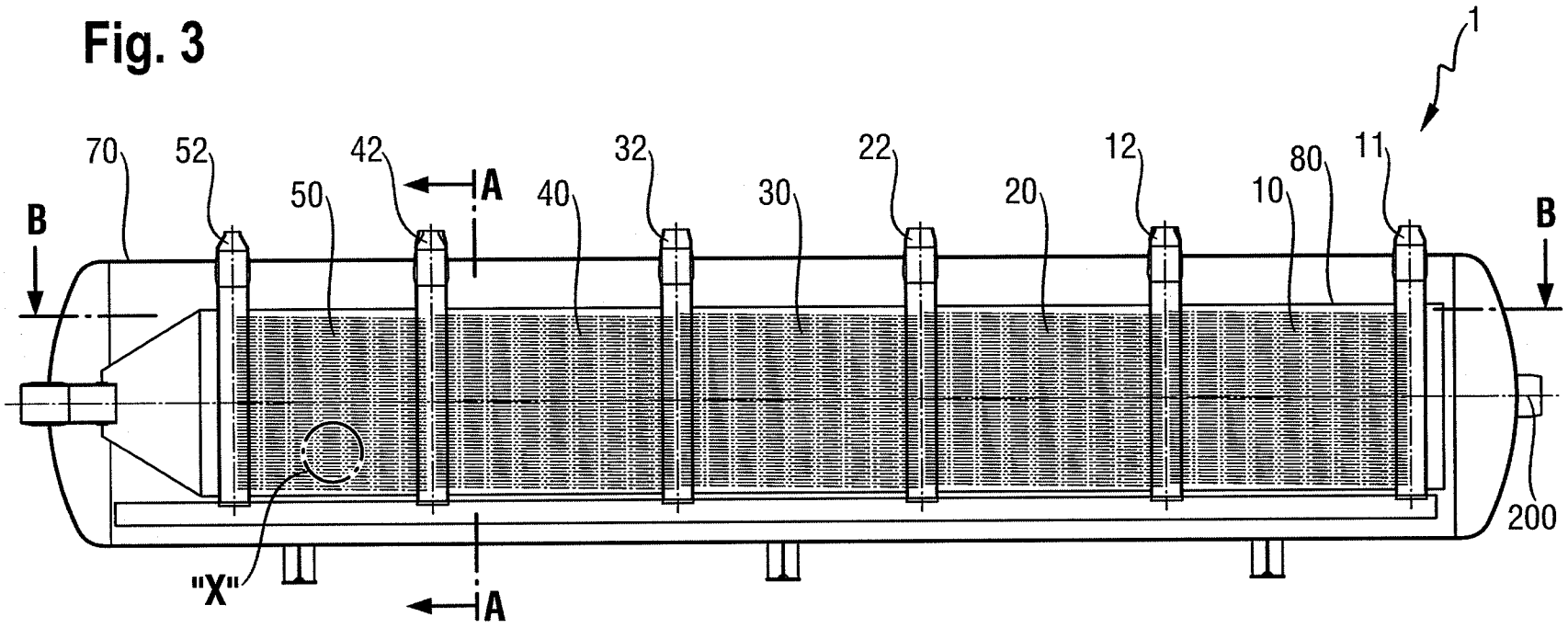
FIG. 3 shows a longitudinal section through a second embodiment variant with horizontal setup.

FIG. 3 shows a further exemplary embodiment of the invention, the heat exchanger 1 being set up horizontally here.

Figure 4:
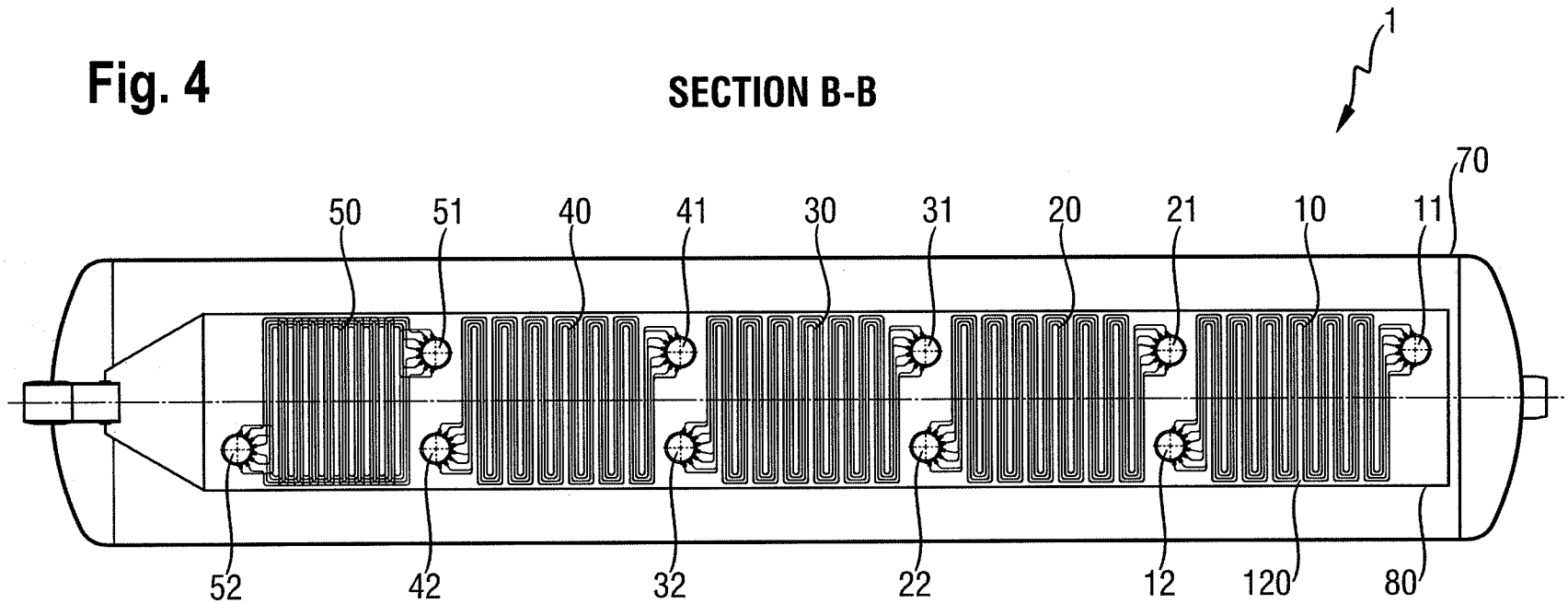
FIG. 4 shows a sectional view along line B-B from FIG. 3.

In FIG. 4, which is a sectional view along line B-B from FIG. 3, the modular construction of the heat exchanger 1 is best visible. The preheater module 10 having the entry manifold 11 and the exit manifold 12 has meandering pipes 120. The construction of the other heat exchanger modules, namely the evaporator modules 20, 30, 40 and the superheater module 50, is identical. They only differ in their dimensions. The evaporator modules 20, 30, 40 are exactly identical, however. The number of the evaporator modules 20, 30, 40 may be adapted as needed. Because exactly identical parts are used, advantages result therefrom in regard to the production costs. In addition, in the event of malfunctions, one or more defective heat exchanger modules may be simply removed and replaced by new ones.

Figure 5:
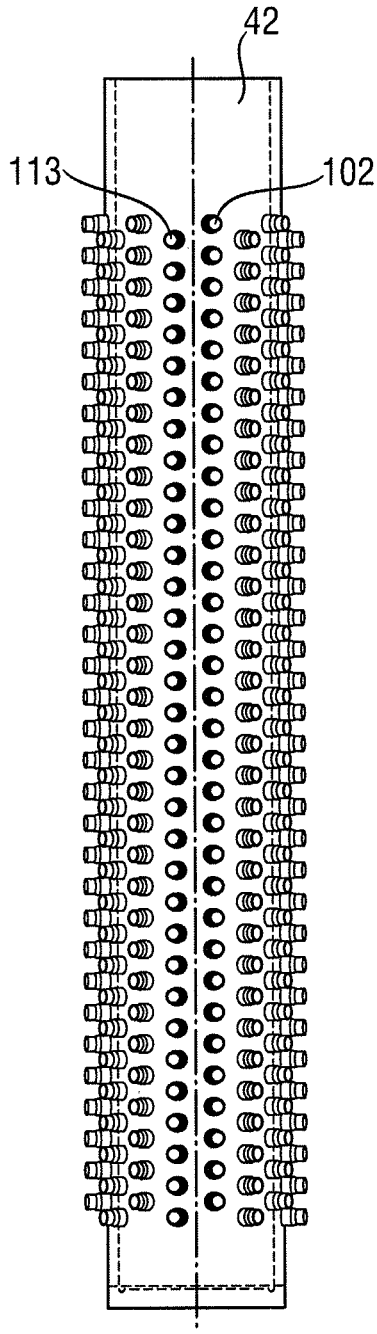
FIG. 5 shows an enlarged detail view from FIG. 8.

A manifold according to the invention is shown enlarged in FIG. 5. This is the exit manifold 42 of the third evaporator module 40. The entry and exit manifolds of the various heat exchanger modules essentially only differ slightly from one another. Advantages of the modular construction are also recognizable here. According to a preferred embodiment, the pipes 101, 102, 103, 104 of a first layer 100 open into the manifold 42 offset in a horizontal plane around an equal angle α. The pipes 111, 112, 113, 114 of a second layer 110 also open into the manifold 42 offset by the same angle α.

Figure 6:
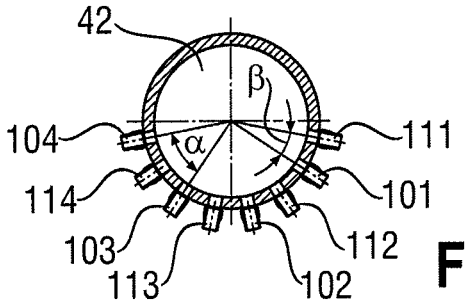
FIG. 6 shows a top view of FIG. 5.

FIG. 6 shows a top view of the manifold 42. The angle α, by which one type of one layer is offset from the next pipe of the same layer, is 45° in this case. The second layer 110, which is vertically adjacent to the first layer 100, is situated offset in relation to the first layer 100 by precisely β=22.5° on the manifold 42, so that the pipes 111, 112, 113, 114 of the second layer 110 are each visible centrally between the pipes 101, 102, 103, 104 of the first layer 100 in FIG. 6. Due to this regular horizontally and vertically offset configuration of junctions on the manifold 42, sufficient spacing for welding work or further manufacturing steps still remains in spite of the high compactness.

Figure 7:
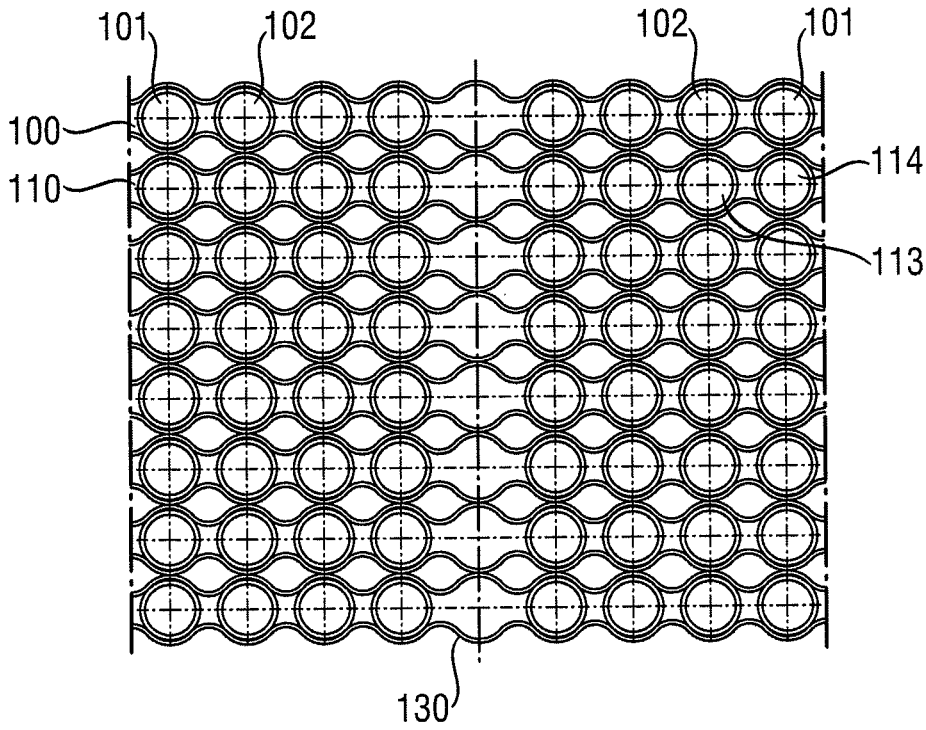
FIG. 7 shows an enlarged detail view from FIG. 3.

FIG. 7 shows the enlarged detail view "X" from FIG. 3. All pipes of the different layers are situated in such a way that they lie vertically precisely one above another. Simple spacers 130 may be situated uniformly due to the horizontally and vertically precise orientation. A further advantage upon the configuration of the pipes 120 in layers is that the flow directions in the vertically adjacent pipe sections 210, which are situated transversely to the central axis 200 of the external shell 70, are opposing.

Figure 8:
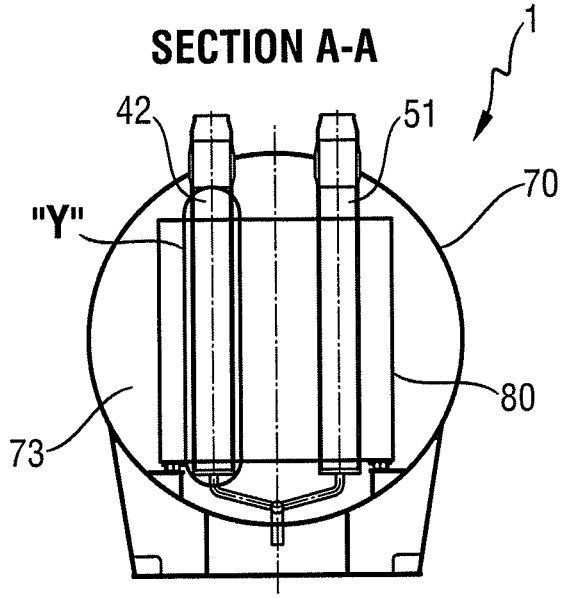
FIG. 8 shows a sectional view along line A-A from FIG. 3.

FIG. 8 shows a further advantage of the invention. The total length of the heat exchanger 1 may be reduced further by the adjacent configuration of the entry and/or exit manifold 42, 51 of adjacent heat exchanger modules 40, 50. The manifolds are typically situated centrally on the central axis 200 of the heat carrier 1.

Figure 9:
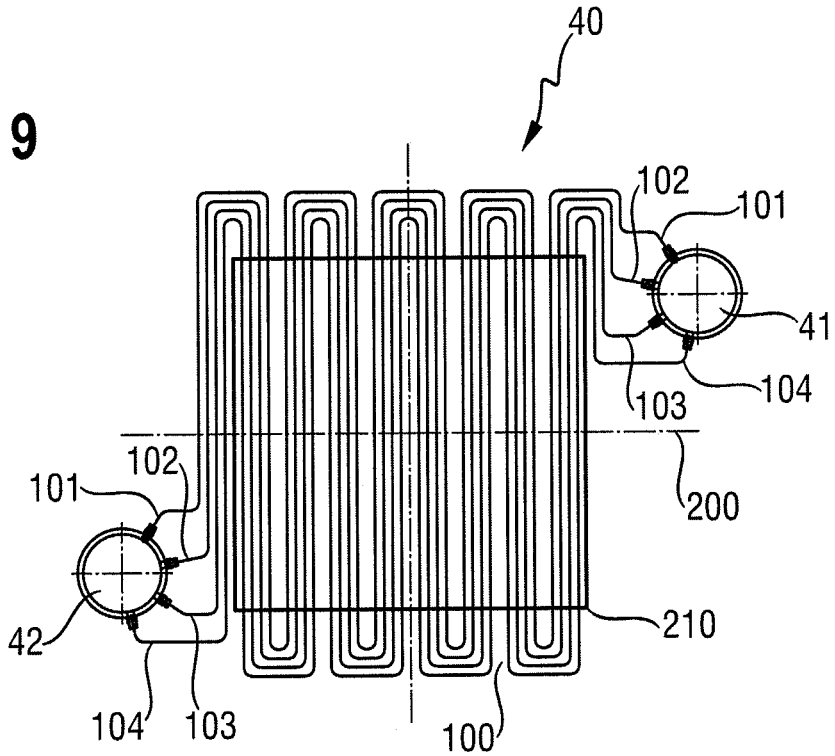
FIGS. 9 and 10 show individual pipe layers.
Figure 10:
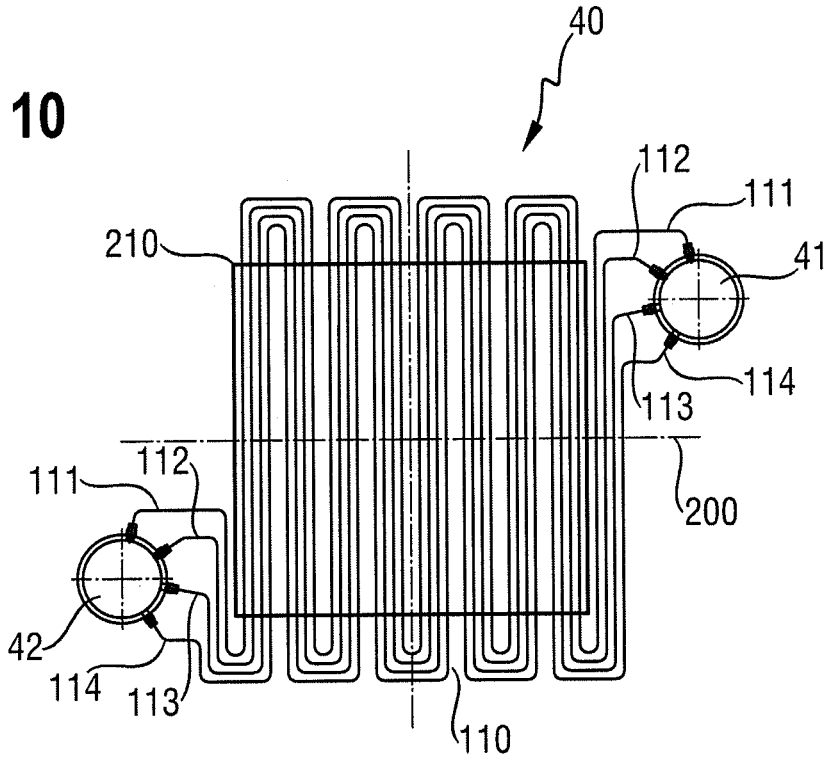

FIGS. 9 and 10 show the construction of the individual pipe layers 100 and 110. In the pipe sections 210, which are situated transversely to the central axis 200 of the external shell 70, each pipe has an opposing direction of the pipe flow in relation to its vertically adjacent pipe in the event of horizontal setup or in relation to its horizontally adjacent pipe in the event of vertical setup.

The invention claimed is:

1. A heat exchanger, comprising:

an external shell; and a plurality of heat exchanger modules disposed within the external shell, wherein said plurality of heat exchanger modules includes:

at least one preheater module, at least one evaporator module, and at least one superheater module, each of the plurality of heat exchanger modules includes:

an entry manifold extending through the external shell, the entry manifold at least partly supported by the external shell, an exit manifold extending through the external shell, the exit manifold at least partly supported by the external shell, and meandering pipes through which a heat-absorbing medium flows from the entry manifold to the exit manifold, when the plurality of heat exchanger modules includes a plurality of evaporator modules, the plurality of evaporator modules are connected in parallel via a steam-collecting drum situated outside the external shell, the entry manifold of each of the plurality of heat exchanger modules is offset from a center axis of the external shell in a plane transverse to the center axis of the external shell, and in an offset direction different from an offset direction of a corresponding heat exchanger module exit manifold, a longitudinal axis of the external shell is aligned with a first direction, each of the plurality of heat exchanger modules has a number of pipe layers, each of the number of pipe layers including an equal number of pipes, each of the number of pipe layers having a plurality of distinct connections to the corresponding entry manifold, centerlines of the equal number of pipes in each of the number of pipe layers being aligned in the first direction, centerlines of corresponding pipes in adjacent pipe layers being aligned in a second direction that is perpendicular to the first direction, and the corresponding pipes in adjacent pipe layers have opposing parallel flow directions of the heat absorbing medium along a third direction, the third direction being perpendicular to the first direction and the second direction.

2. The heat exchanger according to claim 1, wherein the heat-absorbing medium is water.

3. The heat exchanger according to claim 1, wherein the first direction is a horizontal direction.

4. The heat exchanger according to claim 1, wherein the first direction is a vertical direction.

5. The heat exchanger according to claim 1, wherein, for each of the plurality of heat exchanger modules the entry manifold and the exit manifold each have a circular cross-section, adjacent pipes of a first pipe layer are connected to the entry manifold at a predetermined first angle apart from one another on a peripheral plane of the entry manifold, each pipe of a second pipe layer connects to the entry manifold at a predetermined second angle apart from an adjacent pipe of the first pipe layer on a peripheral plane of the entry manifold, and the first angle is greater than the second angle.

6. The heat exchanger according to claim 5, wherein, for each of the plurality of heat exchanger modules adjacent pipes of the first pipe layer are connected to the exit manifold at the first angle apart from one another on a peripheral plane of the exit manifold, each pipe of the second pipe layer connects to the exit manifold at the second angle apart from an adjacent pipe of the first pipe layer on a peripheral plane of the exit manifold.

7. The heat exchanger according to claim 1, wherein the pipes of the plurality of heat exchanger modules are situated in a shared internal housing, which is situated concentrically inside the external shell and has an entry opening and an exit opening for the heat-absorbing medium.

8. The heat exchanger according to claim 1, wherein the plurality of heat exchanger modules includes a plurality of evaporator modules, and a plurality of pipes connects the exit manifold of each of the plurality of evaporator modules to the steam-collecting drum in such a way that the plurality of pipes have a single shared entry into the steam-collecting drum.

9. The heat exchanger according to claim 1, wherein the plurality of heat exchanger modules includes a plurality of evaporator modules, and a plurality of pipes connects the entry manifold of each of the plurality of evaporator modules to the steam-collecting drum in such a way that each of the plurality of pipes has a separate connection to the steam-collecting drum.

10. The heat exchanger according to claim 1, wherein, along the plane transverse to the center axis of the external shell, the offset between the center axis of the external shell and each heat exchanger module entry manifold is the same as and is in an opposite direction from the offset between the center axis of the external shell and each heat exchanger exit manifold.

11. The heat exchanger according to claim 2, further comprising:

a pipeline venting superheated steam from the external shell, wherein the heat-absorbing medium enters the external shell below a first of the plurality of heat exchanger modules, and the pipeline exits the external shell above a last of the plurality of heat exchanger modules which is farthest, among the plurality of heat exchanger modules, from the first of the plurality of heat exchanger modules.

12. The heat exchanger according to claim 11, wherein the last of the plurality of heat exchanger modules comprises a superheater module.

13. A heat exchanger, comprising:

an external shell;

an internal housing disposed within the external shell defining a flow channel therebetween;

a plurality of heat exchanger modules disposed within the external shell; and a steam-collecting drum disposed outside the external shell and fluidly coupled to each of the plurality of heat exchanger modules, wherein each of the plurality of heat exchanger modules includes:

an entry manifold that extends through the external shell, the entry manifold at least partly supported by the external shell, an exit manifold that extends through the external shell, the exit manifold at least partly supported by the external shell, and meandering pipes through which a heat-absorbing medium flows from the entry manifold to the exit manifold, wherein the entry manifold of each of the plurality of heat exchanger modules is offset from a center axis of the external shell in a plane transverse to the center axis of the external shell, and in a direction different from an offset direction of a corresponding heat exchanger module exit manifold, wherein a longitudinal axis of the external shell is aligned with a first direction, wherein each of the plurality of heat exchanger modules has a number of pipe layers, each of the number of pipe layers including an equal number of pipes, each of the number of pipe layers having a plurality of distinct connections to the corresponding entry manifold, centerlines of the equal number of pipes in each of the number of pipe layers being aligned in the first direction, centerlines of corresponding pipes in adjacent pipe layers being aligned in a second direction that is perpendicular to the first direction, and wherein the corresponding pipes in adjacent pipe layers have opposing parallel flow directions of the heat absorbing medium along a third direction, the third direction being perpendicular to the first direction and the second direction.

14. The heat exchanger of claim 13, further comprising:

an entry connector for admitting a heat-dissipating medium into the heat exchanger, the entry connector defining a first aperture through the external shell, the entry connector being fluidly coupled to the flow channel through the first aperture; and an exit connector for discharging the heat-dissipating medium out of the heat exchanger, the exit connector defining a second aperture through the external shell, wherein the plurality of heat exchanger modules includes at least one evaporator module disposed downstream of the flow channel in a heat-dissipating medium flow direction, and at least one preheater module disposed downstream of the at least one evaporator module in the heat-dissipating medium flow direction.

15. The heat exchanger of claim 14, wherein the plurality of heat exchanger modules further includes at least one superheater module disposed downstream of the flow channel and disposed upstream of the at least one preheater module in the heat-dissipating medium flow direction.

16. The heat exchanger of claim 15, wherein the exit connector is disposed closer to the at least one preheater module than to the at least one superheater module in the heat-dissipating medium flow direction.

* * * * *